US011946199B1

(12) United States Patent
Wu

(10) Patent No.: US 11,946,199 B1
(45) Date of Patent: Apr. 2, 2024

(54) CORD

(71) Applicant: JHIH HUEI TRADING CO., LTD., Changhua County (TW)

(72) Inventor: Yung-Yu Wu, Changhua County (TW)

(73) Assignee: JHIH HUEI TRADING CO., LTD., Fuxing Township (TW)

( * ) Notice: Subject to any disclaimer, the term of this patent is extended or adjusted under 35 U.S.C. 154(b) by 0 days.

(21) Appl. No.: 18/082,771

(22) Filed: Dec. 16, 2022

(51) Int. Cl.
*D07B 1/02* (2006.01)
*D07B 1/04* (2006.01)

(52) U.S. Cl.
CPC ..... *D07B 1/02* (2013.01); *D07B 1/04* (2013.01); *D07B 2201/1096* (2013.01); *D07B 2201/202* (2013.01); *D07B 2201/2052* (2013.01); *D07B 2201/2055* (2013.01); *D07B 2201/20907* (2015.07)

(58) Field of Classification Search
CPC ..... D07B 1/02; D07B 2201/102; D07B 2201/1096; D07B 2201/2052; D07B 2201/20907; D07B 1/04; D02G 3/36
See application file for complete search history.

(56) References Cited

U.S. PATENT DOCUMENTS 2,129,504 A * 9/1938 Prindle ..... D03D 15/46 428/464
2,137,692 A * 11/1938 Linke ..... D04B 21/202 66/193
4,176,530 A * 12/1979 Cheynet ..... D03D 41/00 66/193
4,912,781 A * 4/1990 Robins ..... A41D 19/01511 57/200
5,826,421 A * 10/1998 Wilcox ..... A47L 13/20 87/5
5,845,476 A * 12/1998 Kolmes ..... D02G 3/442 57/210
6,015,618 A * 1/2000 Orima ..... D02G 3/406 442/310
6,045,571 A * 4/2000 Hill ..... A61L 17/12 606/228
7,549,201 B2 * 6/2009 Kraft ..... A43C 9/00 24/713
11,771,178 B1 * 10/2023 Wu ..... A43C 9/00 24/715.3
2015/0152595 A1 * 6/2015 Van Wunnik ..... D07B 1/04 87/6

FOREIGN PATENT DOCUMENTS

CN 2663489 Y * 12/2004 ..... D07B 1/02
CN 104099722 B * 3/2016 ..... D04B 21/202

* cited by examiner

*Primary Examiner* — Shaun R Hurley
(74) *Attorney, Agent, or Firm* — Muncy, Geissler, Olds & Lowe, P.C.

(57) ABSTRACT

A cord is provided, including: a core material and an outer layer. The core material includes a plurality of first strands braided with one another, and the outer layer is disposed around the core material and includes a plurality of second strands knitted with one another.

9 Claims, 2 Drawing Sheets

CORD

BACKGROUND OF THE INVENTION

Field of the Invention

The present invention relates to a cord.

Description of the Prior Art

A conventional cord is woven by a plurality of strands in a single weaving method, and an appearance of the cord can only be changed by changing the weaving method or color of the plurality of strands, which limits the variability of the cord and requires complicated processing steps. In addition, the conventional cord is generally formed as a flat rope or round rope with a smooth outer surface that provides insufficient friction force so that the cord is easy to loosen when tied and has poor structural strength.

The present invention is, therefore, arisen to obviate or at least mitigate the above-mentioned disadvantages.

SUMMARY OF THE INVENTION

The main object of the present invention is to provide a cord, which is not easy to loosen when tied and provides special and diverse appearance.

To achieve the above and other objects, the present invention provides a cord, including: a core material and an outer layer. The core material includes a plurality of first strands braided with one another. The outer layer is disposed around the core material and includes a plurality of second strands knitted with one another.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
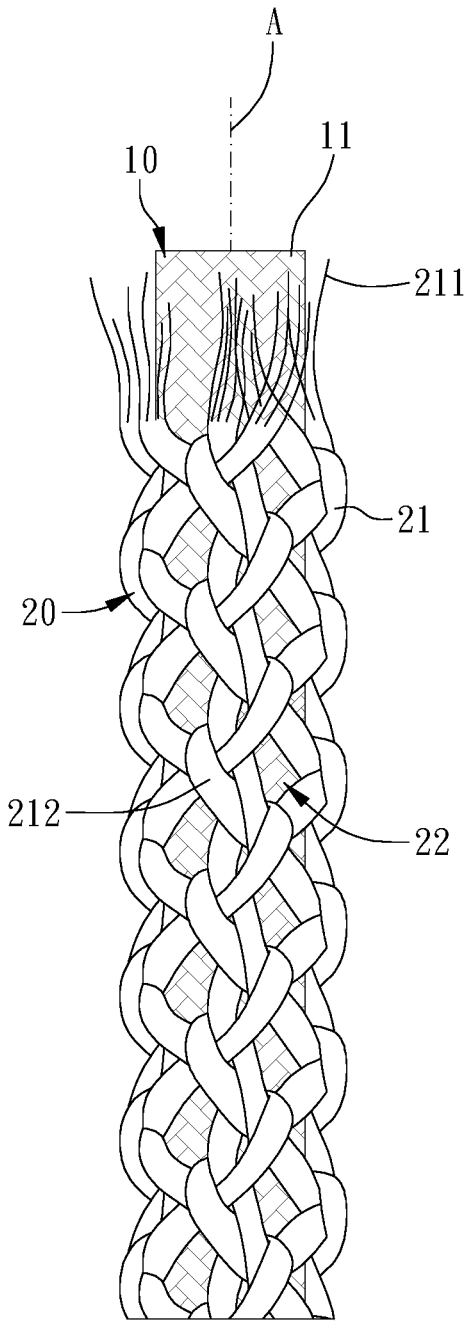
FIG. 1 is a stereogram of a preferable embodiment of the present invention.
Figure 2:
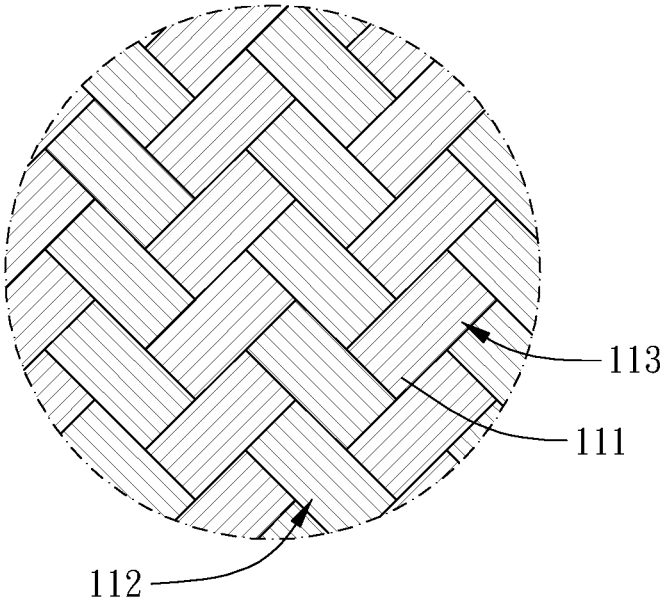
FIG. 2 is a partial enlargement of a preferable embodiment of the present invention.

Please refer to FIGS. 1 to 2 for a preferable embodiment of the present invention. A cord of the present invention includes a core material 10 and an outer layer 20.

The core material 10 includes a plurality of first strands 11 braided with one another. The outer layer 20 is disposed around the core material 10 and includes a plurality of second strands 21 knitted with one another. The plurality of second strands 21 provides the cord with a relatively concave-convex outer surface so that the cord is not easy to loosen when tied and is convenient to use.

In this embodiment, the plurality of first strands 11 are free of intertwining with the plurality of second strands 21 so that at least a part of the outer layer 20 is movable relative to the core material 10, which maintains the stretchability of the core material 10 and the outer layer 20. The outer layer 20 protects the core material 10 from abrasion for good durability. Before fixing the core material 10 with the outer layer 20, the outer layer 20 can be compressed or stretched in the axial direction A so as to change the touch, a stretch ratio and the visual effect of the cord. Preferably, a denier of each of the plurality of first strands 11 is smaller than or equal to a denier of each of the plurality of second strands 21. Therefore, the core material 10 has a dense and smooth surface, and the plurality of second strands 21 protrude beyond the surface of the core material 10 to provide sufficient frictional resistance and be wear-resistant. Specifically, each of the plurality of first strands 11 is an untwisted yarn formed of a plurality of first filaments 111, and each of the plurality of second strands 21 is an untwisted yarn formed of a plurality of second filaments 211 so as to provide a fabric structure which is fluffy and compressible. Colors of the plurality of first filaments 111 and the plurality of second filaments 211 may be identical with or different from one another according to different requirements. In other embodiments, each of the plurality of first strands may be formed by twisting or weaving the plurality of first filaments; each of the plurality of second strands may be formed by twisting or weaving the plurality of second filaments so as to provide fabric structures with different appearance, touch and stretchability.

Moreover, the core material 10 defines an axial direction A, and the plurality of first strands 11 are braided to form a plurality of first segments 112 and a plurality of second segments 113. Each of the plurality of first segments 112 and each of the plurality of second segments 113 obliquely extend in different directions relative to the axial direction A, and every adjacent one of the plurality of first segments 112 and one of the plurality of second segments 113 define an angle therebetween, as shown in FIG. 2, so as to provide a dense and smooth surface and good structural strength. In this embodiment, a length of each of the plurality of first segments 112 is larger than a width of one of the plurality of second segments 113, and each said angle is smaller than or equal to 90 degrees. The plurality of first segments 112 are arranged adjacent to one another in the axial direction A and parallel to one another, and the plurality of second segments 113 are arranged adjacent to one another in the axial direction A and parallel to one another. In a circumferential direction of the core material 10, the plurality of first segments 112 and the plurality of second segments 113 are alternatively arranged so as to have good structural strength and preferable appearance. Preferably, a color of at least one of the plurality of first strands 11 is different from a color of one of the plurality of second strands 21 for diverse visual effect. The core material 10 may include a hollow sleeve formed of the plurality of first strands 11 and a wire disposed through the hollow sleeve, and the core material 10 may also be a flat rope or a solid rope formed of the plurality of first strands 11.

The plurality of second strands 21 define a plurality of meshes 22, and the core material 10 is partially exposed from the plurality of meshes 22 so as to have special visual effect. Each of the plurality of second strands 21 meanderingly extends along an outer circumferential wall of the core material 10 and forms a plurality of loops 212, and the plurality of loops 212 are sleeved with one another to connect the plurality of second strands 21. A radial dimension of each of the plurality of loops 212 is smaller than or equal to a radial dimension of each of the plurality of meshes 22 so that the plurality of loops 212 defining the plurality of meshes 22 provide sufficient structural strength. As viewed in the axial direction A of the core material 10, every adjacent two of the plurality of loops 212 of one of the plurality of second strands 21 are misaligned with each other so as to extend around an outer surface of the core material 10, and the plurality of second strands 21 are meanderingly wound with one another and not easy to separate from one another. The radial dimension of at least one of the plurality of meshes 22 is larger than or equal to 2 mm so that the outer surface of the core material 10 is sufficiently exposed outward to have special visual effect.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A cord, including:

a core material, including a plurality of first strands braided with one another; and an outer layer, disposed around the core material, including a plurality of second strands knitted with one another;

wherein a denier of each of the plurality of first strands is smaller than or equal to a denier of each of the plurality of second strands.

2. The cord of claim 1, wherein the plurality of first strands are free of intertwining with the plurality of second strands.

3. The cord of claim 2, wherein each of the plurality of second strands extends meanderingly along an outer circumferential wall of the core material and forms a plurality of loops, and the plurality of loops are sleeved with one another to connect the plurality of second strands.

4. The cord of claim 3, wherein the plurality of second strands define a plurality of meshes, the core material is partially exposed from the plurality of meshes, and a radial dimension of each of the plurality of loops is smaller than or equal to a radial dimension of each of the plurality of meshes.

5. The cord of claim 3, wherein as viewed in an axial direction of the core material, every adjacent two of the plurality of loops of one of the plurality of second strands are misaligned with each other.

6. The cord of claim 1, wherein the core material defines an axial direction, the plurality of first strands are braided to form a plurality of first segments and a plurality of second segments, each of the plurality of first segments and each of the plurality of second segments obliquely extend in different directions relative to the axial direction, and every adjacent one of the plurality of first segments and one of the plurality of second segments define an angle therebetween.

7. The cord of claim 6, wherein a length of each of the plurality of first segments is larger than a width of one of the plurality of second segments, and each said angle is smaller than or equal to 90 degrees.

8. The cord of claim 7, wherein the plurality of first strands are free of intertwining with the plurality of second strands; each of the plurality of second strands extends meanderingly along an outer circumferential wall of the core material and forms a plurality of loops, and the plurality of loops are sleeved with one another to connect the plurality of second strands; the plurality of second strands define a plurality of meshes, the core material is partially exposed from the plurality of meshes, and a radial dimension of each of the plurality of loops is smaller than or equal to a radial dimension of each of the plurality of meshes; the radial dimension of at least one of the plurality of meshes is larger than or equal to 2 mm; as viewed in an axial direction of the core material, every adjacent two of the plurality of loops of one of the plurality of second strands are misaligned with each other; each of the plurality of first strands is an untwisted yarn formed of a plurality of first filaments, and each of the plurality of second strands is an untwisted yarn formed of a plurality of second filaments; a color of at least one of the plurality of first strands is different from a color of one of the plurality of second strands; the plurality of first segments are arranged adjacent to one another in the axial direction and parallel to one another, and the plurality of second segments are arranged adjacent to one another in the axial direction and parallel to one another; and in a circumferential direction of the core material, the plurality of first segments and the plurality of second segments are alternatively arranged.

9. A cord, including:

a core material, including a plurality of first strands braided with one another; and an outer layer, disposed around the core material, including a plurality of second strands knitted with one another;

wherein each of the plurality of first strands is an untwisted yarn formed of a plurality of first filaments, and each of the plurality of second strands is an untwisted yarn formed of a plurality of second filaments.

* * * * *